US007444937B2

(12) United States Patent
Magnan et al.

(10) Patent No.: US 7,444,937 B2
(45) Date of Patent: Nov. 4, 2008

(54) PYROTECHNIC SAFETY DEVICE WITH MICRO-MACHINED BARRIER

(75) Inventors: Pierre Magnan, Saint Palais (FR); Renaud Lafont, Bourges (FR)

(73) Assignee: Giat Industries, Versailles (FR)

( * ) Notice: Subject to any disclaimer, the term of this patent is extended or adjusted under 35 U.S.C. 154(b) by 51 days.

(21) Appl. No.: 11/584,631

(22) Filed: Oct. 23, 2006

(65) Prior Publication Data

US 2007/0101888 A1 May 10, 2007

(30) Foreign Application Priority Data

Oct. 27, 2005 (FR) ..... 05 11121

(51) Int. Cl.
*F42C 15/34* (2006.01)
*F42C 15/00* (2006.01)

(52) U.S. Cl. ..... 102/254; 102/222; 102/221

(58) Field of Classification Search ..... 102/254, 102/221–222, 262
See application file for complete search history.

(56) References Cited

U.S. PATENT DOCUMENTS

| | | | | |
|---|---|---|---|---|
| 617,650 | A | 1/1899 | Gesche et al. | |
| 3,750,589 | A * | 8/1973 | Egli et al. | 102/237 |
| 6,431,071 | B1 * | 8/2002 | Hodge et al. | 102/254 |
| 6,439,119 | B1 | 8/2002 | Smith et al. | |
| 6,564,716 | B1 * | 5/2003 | Steele et al. | 102/239 |
| 6,622,629 | B2 * | 9/2003 | Hodge et al. | 102/235 |
| 6,634,301 | B1 * | 10/2003 | Mulinix | 102/336 |
| 6,691,513 | B1 | 2/2004 | Kolesar | |
| 6,964,231 | B1 | 11/2005 | Robinson et al. | |
| 7,051,656 | B1 * | 5/2006 | Koehler et al. | 102/249 |
| 7,055,437 | B1 | 6/2006 | Robinson et al. | |
| 7,069,861 | B1 * | 7/2006 | Robinson et al. | 102/222 |
| 7,322,294 | B1 * | 1/2008 | Laib | 102/254 |
| 2003/0070571 | A1 * | 4/2003 | Hodge et al. | 102/221 |
| 2004/0027029 | A1 | 2/2004 | Borwick, III et al. | |
| 2005/0139577 | A1 | 6/2005 | Kim et al. | |
| 2006/0070547 | A1 * | 4/2006 | Combes et al. | 102/222 |
| 2007/0101888 | A1 * | 5/2007 | Magnan et al. | 102/254 |
| 2007/0131127 | A1 * | 6/2007 | Magnan et al. | 102/222 |

FOREIGN PATENT DOCUMENTS

| | | | |
|---|---|---|---|
| EP | 1 189 012 | A2 | 3/2002 |
| EP | 1189012 | A2 * | 3/2002 |
| EP | 1 559 986 | A1 | 8/2005 |
| EP | 1559986 | A1 * | 8/2005 |
| FR | 2 650 662 | A1 | 2/1991 |
| FR | 2 801 099 | A1 | 5/2001 |
| FR | 2801099 | A1 * | 5/2001 |
| WO | WO 2004/027832 | A2 | 4/2004 |

* cited by examiner

*Primary Examiner*—James S. Bergin
*Assistant Examiner*—Michael D David
(74) *Attorney, Agent, or Firm*—Oliff & Berridge, PLC

(57) ABSTRACT

The invention relates to a firing safety device for a pyrotechnic device, such device incorporating at least one barrier to block a transmission channel connecting an igniter and a pyrotechnic charge, wherein the barrier is made in the form of at least one micro-machined or micro-engraved element, applied to or made on at least one substrate board, the board being integrated on its edge such that it is substantially parallel to the transmission channel which thus opens out opposite the barrier at its thick part, the pyrotechnic charge and igniter thus lying on either side of the barrier and opposite the thickness of the barrier.

10 Claims, 4 Drawing Sheets

PYROTECHNIC SAFETY DEVICE WITH MICRO-MACHINED BARRIER

BACKGROUND OF THE INVENTION

1. Field of the Invention

The technical scope of the invention is that of firing safety devices for pyrotechnic devices.

2. Description of the Related Art

Safety devices (or SADs) are well known. They generally incorporate a barrier blocking a transmission channel which connects an igniter to a pyrotechnic charge.

The barrier thus positions itself in the way of the flame between the igniter and the charge thereby preventing the priming or firing of the latter.

Patents FR-2650662 and FR-2801099 thus disclose such known safety devices.

One of the problems encountered with these devices is their encumberment. The parts are relatively solid to ensure the interruption of the pyrotechnic train. The motor means enabling the barrier to be displaced must thus be powerful. More often than not, it is springs which are used, such springs remaining tensed during the storage phases possibly leading to a deterioration of their mechanical properties and a reduction in arming reliability.

Small electric motors may be used, but these are cumbersome, fragile, difficult to integrate and require a substantial power source.

For the last few years, it has been proposed to make all or part of safety devices using chips incorporating electro-mechanical elements micro-machined or micro-engraved either on or in an element applied to a substrate or directly on or in the substrate itself. This technology, known under the name of MEMS (Micro Electro Mechanical System), indeed enables us today to manufacture micro-devices by implementing a technique close to that used in the manufacture of electronic integrated circuits.

Patents EP-1559986 and U.S. Pat. No. 617,650 disclose such safety devices.

However, to date this technique is only implemented to manufacture electric contacts or barriers enabling an optical firing signal to be interrupted, or else projectable elements for igniters ("slapper" type detonators).

Such barriers are not directly positioned between the pyrotechnic igniter and the charge, and the interruption of the pyrotechnic train is not ensured.

Patent EP-1189012 discloses a miniature safety device in which a transmission channel receives an igniter. This channel is blocked, firstly by a first barrier held in place by a lock, and secondly by a second barrier, transverse to the first one, and able to slide via the action of an actuator.

The dimensions of such a device are relatively large since the igniter has substantially the same diameter as the transmission channel. Moreover, the pyrotechnic charge ignited by this device is positioned in a direction perpendicular to the plane of the barrier and can only be ignited through a transverse slot in the second barrier and after both barriers have been moved.

Such a device is both complicated and relatively cumbersome. The energy supplied by the igniter is partly used to unlock and move the barrier. The residual energy alone is used to ignite a pyrotechnic composition. Such a principle gives rise to malfunctions and is unreliable.

SUMMARY OF THE INVENTION

The aim of the invention is to propose a firing safety device of reduced mass but which is nevertheless both reliable and efficient.

The invention thus proposes a safety device implementing MEMS technologies but also enabling the interruption of the pyrotechnic ignition train between an igniter and a charge to be ensured.

Thus the invention relates to a firing safety device for a pyrotechnic device, such device incorporating at least one barrier to block a transmission channel connecting an igniter and a pyrotechnic charge, device wherein the barrier is made in the form of at least one micro-machined or micro-engraved part, applied to or made on at least one substrate board, the board being oriented such that it is substantially parallel to the transmission channel which thus opens out opposite the barrier at its thick part, the pyrotechnic charge and igniter thus lying on either side of the barrier and opposite the thickness of the barrier.

Advantageously, the transmission channel will have a section whose surface area will be less than or equal to 1 $mm^2$ whilst being chosen greater than the priming surface area of the pyrotechnic charge.

The barrier may be moved by the action of motor means between a safety position in which it blocks the transmission channel and an armed position in which it unblocks at least partially one part of the transmission channel, the motor means being made in the form of parts that are micro-machined or micro-engraved on the board or boards.

The device may incorporate at least two micro-machined or micro-engraved boards stacked on top of one another, control means ensuring the synchronised movement of the barrier or barrier elements of the different boards.

The barrier may comprise at least two elements able to move with respect to one another to unblock the transmission channel.

The barrier elements may incorporate matching profiles at their contact zone whose juxtaposition will constitute at least one deflector ensuring gastightness for the gases generated by the igniter.

The motor means may be designed so as to ensure the reversibility of the barrier or barriers.

Each barrier or barrier element may be held in the safety position by a lock micro-machined or micro-engraved onto the board in question.

BRIEF DESCRIPTION OF THE DRAWINGS

The invention will become more apparent from the following description of different embodiments, such description made with reference to the appended drawings, in which.

DETAILED DESCRIPTION OF PREFERRED EMBODIMENTS

Figure 1:
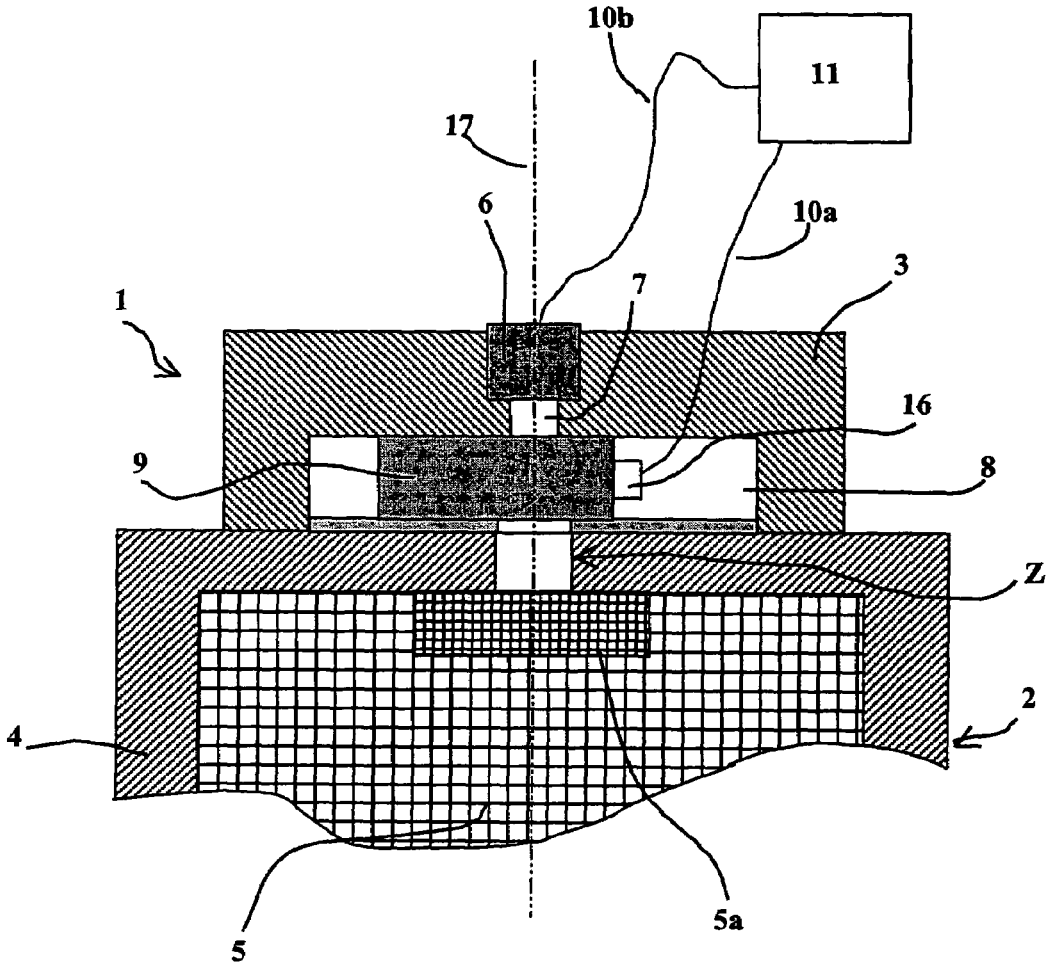
FIG. 1 shows a schematic section view of a safety device according to the invention.

With reference to FIG. 1, a firing safety device 1 for a pyrotechnic device 2 according to the invention incorporates a casing 3 that is fixed by means (not shown) to the case 4 of the pyrotechnic device 2.

The case 4 encloses a pyrotechnic charge 5 (for example, an explosive onto which a priming relay 5*a* is set) and the safety device 1 has an igniter 6. The igniter 6 is directly connected to the explosive charge 5 by a transmission channel 7. This channel is linear and does not contain any pyrotechnic composition. It acts as a guide for the gases generated by the igniter 6 and directs them towards the explosive charge 5.

The casing 3 encloses a cavity 8 inside which a case 9 is placed which incorporates the means to ensure the interruption of the pyrotechnic train (means not shown in this Figure).

The case 9 and igniter 6 are connected by electrical linking means 10*a*, 10*b*, 16 to electronic control means 11.

The device is armed only further to the detection of a certain number of events obligatorily associated with firing (for example, firing acceleration for a projectile). It is means 11 which manage these events. They are thus connected to sensors (not shown) and incorporate event management software.

With the device according to the invention, the means ensuring the interruption of the pyrotechnic train will comprise micro-machined or micro-engraved elements (MEMS).

Since these elements are small in dimension, it is necessary for the whole pyrotechnic train (6, 5*a*, 5) to be assembled so as to reduce the effects of priming.

It is thus necessary for the whole of the pyrotechnic train to be optimised and an igniter 6 implemented which is of the smallest size able to ensure functioning, such igniter being coupled with an appropriate pyrotechnic relay 5*a* which is positioned on the side of the pyrotechnic charge 5.

It has been verified that by implementing an igniter incorporating an output stage of 10 milligrams of cyclonite coupled with a very insensitive relay, for example of HNS (hexanitrostilbene), it is possible to make a transmission channel 7 with a section of less than 1 $mm^2$ (channel diameter of around one mm) whilst ensuring the required ignition transmission. Note that classical igniters have an output stage of around 30 milligrams of cyclonite. The igniter 6 selected is thus of reduced power.

Indeed, the critical diameter of the HNS is of 0.5 mm and to be ignited this explosive thus requires a priming surface of approximately 0.2 $mm^2$ which is much less than the section of the transmission channel.

It has also been verified that it is possible to ensure the interruption of the pyrotechnic effect using a silicon barrier of around 3 mm in thickness, which can be produced using MEMS technology.

Figure 2:
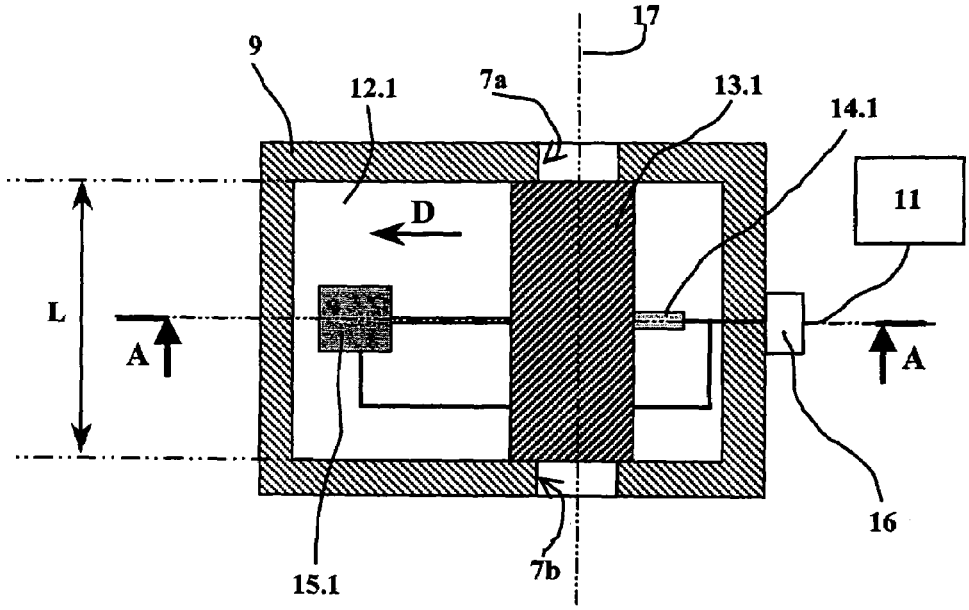
FIGS. 2 and 3 show part of the device according to a first embodiment of the invention in its safety position, FIG. 2 being a section along plane BB in FIG. 3 and FIG. 3 being a section along plane AA in FIG. 2.
Figure 3:
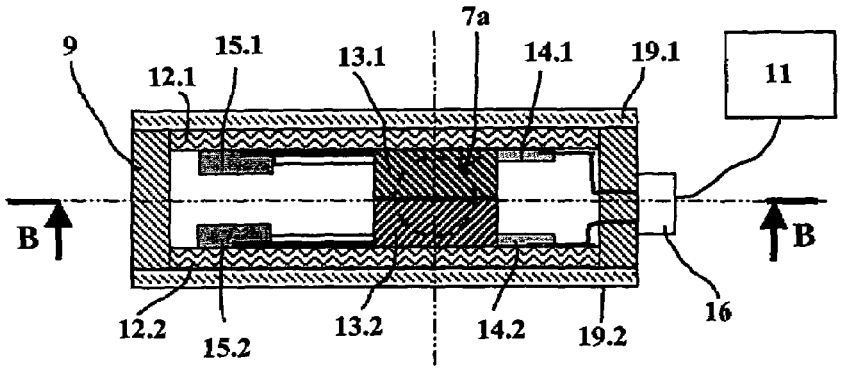

It is thus possible to implement micro-machined technology (MEMS) on condition of being able to position a length of silicon of around 3 mm between the igniter and the pyrotechnic charge. This length is indeed enough to stop the pyrotechnic effects due to an inadvertent ignition of the igniter chosen. FIGS. 2 and 3 show a first embodiment of an MEMS technology case 9 according to the invention.

Generally speaking, the thickness of micro-machined elements does not exceed half a millimetre. To block a channel 7 of 1 mm in diameter it is thus necessary to stack at least two micro mechanisms on top of one another and thus associate two identical barriers positioned one on the other.

The case 9 thus encloses two substrate boards 12.1 and 12.2, for example an insulating substrate such as silicon, each bonded onto a glass plate 19.1, 19.2 closing the case.

Each substrate carries a barrier 13.1, 13.2 made in the form of a part micro-machined (or micro-engraved) in the silicon substrate. Slight play (a few microns) in the assembly will be provided to enable the conjunctive movements of the barriers 13 carried by the two boards.

Gastightness is not absolute. The diameter of the output opening Z could be reduced—see FIG. 1—(whilst keeping it greater than or equal to the diameter of channel 7) to reduce the effects on the relay 5*a* of an ignition in the safety state of the device.

Alternatively, it would be possible to make the barrier on another board (a thicker one) and deposit it thereafter on the substrate 13.1, 13.2 in question.

The case 9 has two cylindrical openings 7*a* and 7*b* with the same axis 17 which prolong the transmission channel 7.

In FIG. 2 the device is shown in a safety position in which the barriers 13.1, 13.2 are positioned between the openings 7*a* and 7*b* thus blocking the transmission channel 7.

Each barrier is kept locked by a micro-machined lock 14.1, 14.2 which may, for example, be constituted by a thermal fuse, or electrothermal or electromagnetic actuator.

Once unlocked, each barrier 13.1, 13.2 is moved by the action of motor means 15.1, 15.2 which will be, for example, a micro-machined spring or a micro electric vibrating, or friction or thermal motor.

The locks and motors will preferably be designed so as to ensure the reversibility of the barrier control from the safety state to the armed state and vice versa.

The Figures also feature a connector 16 which enables the case 9 to be joined with the electronic control means 11. These control means are, moreover, designed so as to ensure the synchronised movement of barriers 13.1, 13.2 of boards 12.1, 12.2.

The Figures also shown, in bold lines, certain conductors carried by the boards 12.1, 12.2 and connecting the micro-machined locks and actuators to the connector 16.

Figure 4:
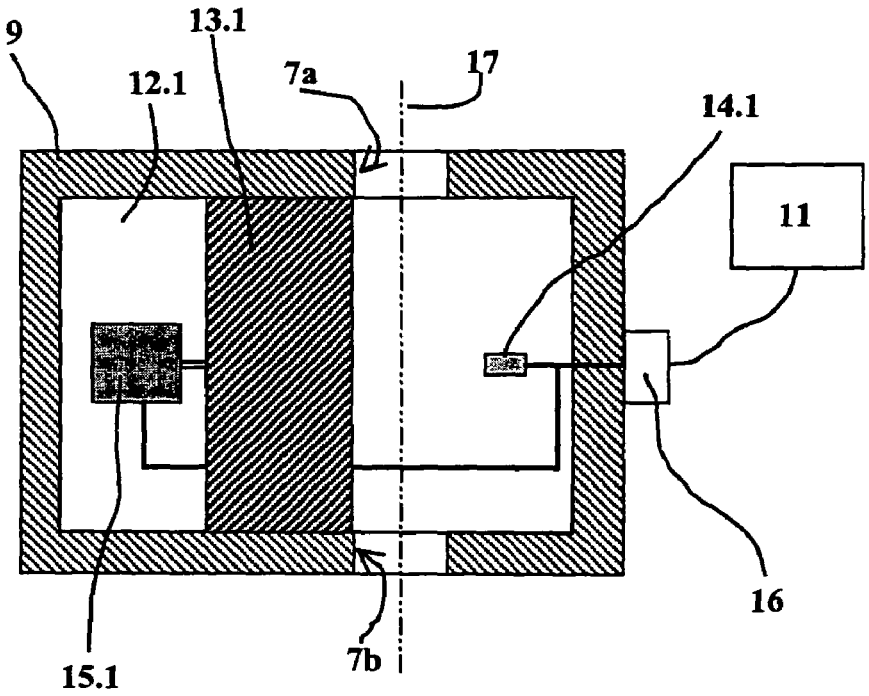
FIG. 4 is analogous to FIG. 2 but shows the device in its armed position.

Each barrier 13.1, 13.2 has a substantially parallelepipedic geometry and moves on the plane of its substrate 12.1, 12.2 in direction D (FIG. 2) to take up its armed position (FIG. 4).

In classical mechanical safety devices, the transmission channel has an axis that passes through the barrier following the latter's thickness. The transmission channel is thus usually perpendicular to the plane on which the barrier slides.

With a barrier made using micro-machined technology (MEMS) the thickness of silicon is too reduced to stop a pyrotechnic effect (a thickness of a micro-machined element is usually of a few hundred microns).

In accordance with the invention, barriers 13.1, 13.2 thus receive the pyrotechnic effect in a direction 17 parallel to their plane of movement 12.1, 12.2.

Boards 12.1, 12.2 are thus integrated on their edge such that they are substantially parallel to the transmission channel 7.

The transmission channel has its axis 17 which thus passes through each barrier following a dimension L well above that of its thickness. It is thus possible to produce barriers 13.1, 13.2 using MEMS technology, which have a dimension L of around a few millimetres.

Thanks to the invention, it is possible to define a safety device in which the barrier is micro-machined and positioned such that, both the pyrotechnic charge and the igniter itself are on either side of the barrier.

The pyrotechnic elements are thus positioned opposite the thickness of the barrier. They exert their effect in a direction which is in the plane of movement of the barrier and not perpendicularly to this plane of movement, unlike in classical solutions. The thickness of the barrier thus position may be maximal using a barrier which is however minimal such as may be obtained using micro-machining technologies.

Someone skilled in the art will easily determine the structure of the different micro-machined elements. Electrothermal or electromagnetic actuators are well known in the field of MEMS. The same applies to micro-machined fuses and springs. Reference may be made, for example, to patents EP-1573782, US 2005139577, U.S. Pat. No. 6,691,513 and US 2004027029 which disclose possible solutions.

Figure 7:
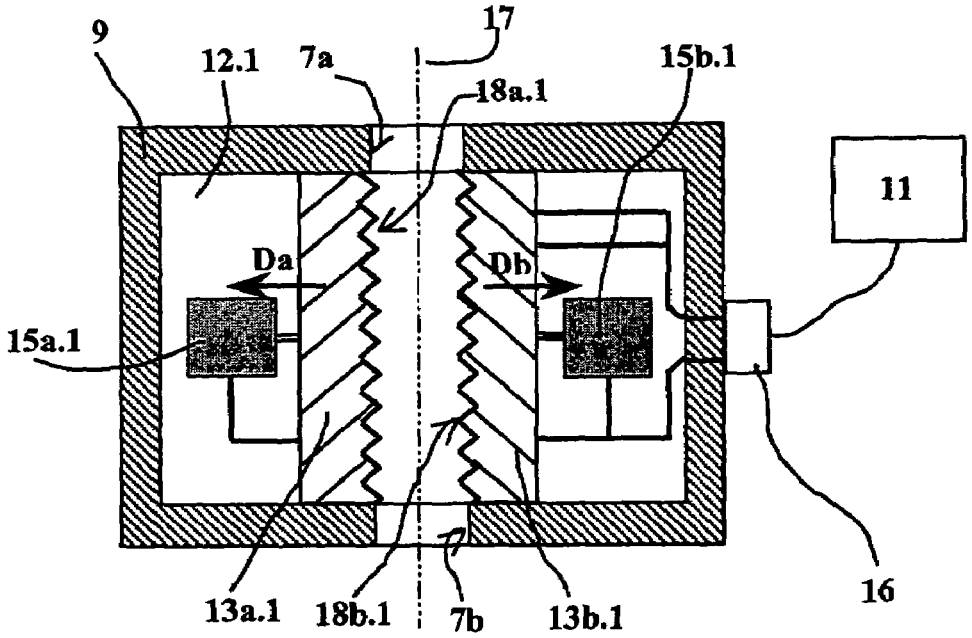
FIG. 7 is analogous to FIG. 5 but shows the device in its armed position.
Figure 5:
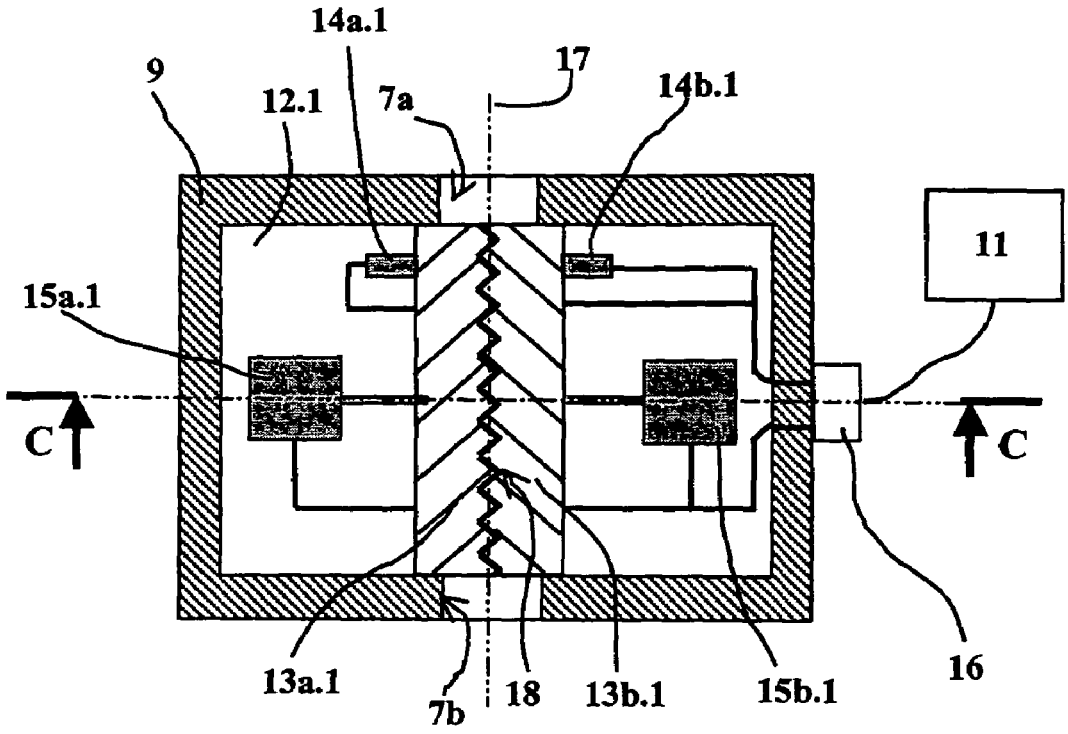
FIGS. 5 and 6 show part of the device according to a second embodiment of the invention in its safety position, FIG. 5 being a section along plane DD in FIG. 6 and FIG. 6 being a section along plane CC in FIG. 5.
Figure 6:
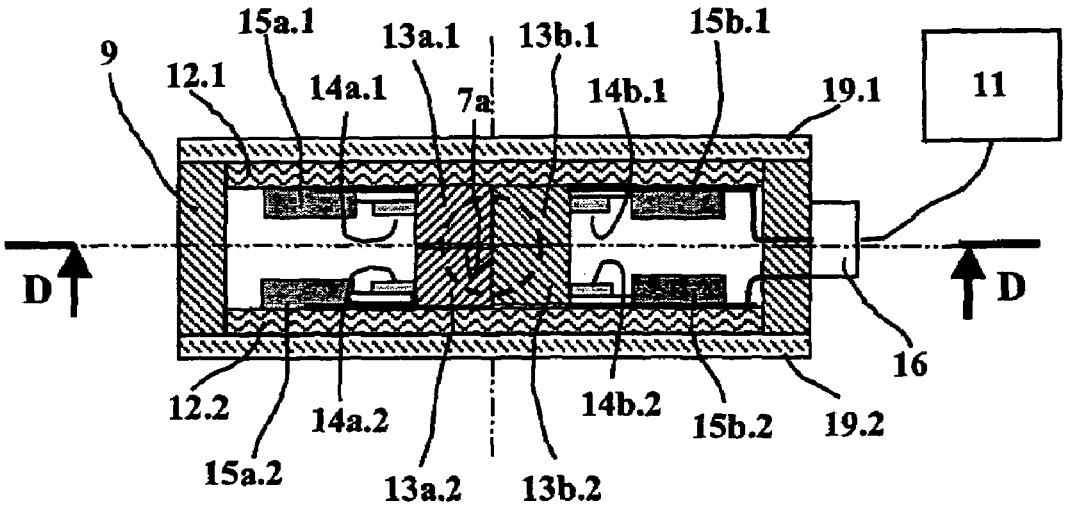

FIGS. 5 to 7 show a second embodiment of a case 9 according to the invention using MEMS technology.

This embodiment differs from the previous one in that each barrier 13.1 or 13.2 is divided into two elements which are mobile with respect to one another.

Thus, substrate 12.1 carries two barrier elements 13*a*.1 and 13*b*.1 and substrate 12.2 carries two barrier elements 13*a*.2 and 13*b*.2.

Each barrier element can be moved by motor means 15*a*.1, 15*b*.1; 15*a*.2, 15*b*.2.

Locking means 14*a*.1, 14*b*.1 or 14*a*.2, 14*b*.2 enable the immobilisation of each barrier element in question on each board.

Slight play (a few microns) in the assembly will be provided to enable the conjunctive movements of elements 13 carried by the two boards.

Each board 12.1, 12.2 is connected to the electronic control means 11 which are designed so as to ensure the synchronised movement of elements 13*a*.1, 13*b*.1; 13*a*.2, 13*b*.2 of the different boards.

The Figures show a connector 16 which ensures an interface between the boards and the cable from the control means 11. The Figures also show, schematically, in bold lines, certain conductors on the boards 12.1, 12.2 which link the micro-machined locks and actuators to the connector 16.

When the device is in its safety position (FIG. 5), the two elements constituting each barrier are in contact with one another substantially level with the axis 17 of the priming channel. The contact surfaces preferably have matching profiles 18*a*, 18*b*.

According to the embodiment shown here, the profiles are constituted by a succession of toothing delimited by planes inclined with respect to the axis 17 of the channel 7.

The juxtaposition of the toothing thereby constitutes deflectors which improve the gastightness with respect to the gases generated by the igniter 6.

FIG. 7 shows the device in its armed position. Each motor means has moved an element in a direction Da or Db. The channel 7 is thus unblocked and the charge 5, 5*a* may be ignited.

Each element 13*a*, 13*b* of each barrier is thus displaced by a distance substantially equal to the half-diameter of the channel. The movements are thus of reduced amplitude thereby enabling a reduction in the size of the device and minimal energy to ensure unlocking.

FIGS. 1 to 7 are naturally schematic and do not presume the dimensions and proportions of the different components which are shown.

Different variants are possible without departing from the scope of the invention.

It is thus possible (for one or other of the previous embodiments) to provide more than two substrate boards 12 carrying mobile elements.

Naturally, each board will be connected to electronic control means which will enable the synchronised movement of the micro-machined elements forming the barriers carried by the different boards to be ensured.

Such a solution will enable the device to be adapted to a larger diameter for the transmission channel.

Inversely, it would be possible for a device to be made according to the invention in which there would only be a single board carrying a mobile barrier formed of one or several elements. This solution is envisageable if it is possible for the diameter of the transmission channel to be sufficiently reduced for it to be substantially equal to the thickness of the mobile barrier.

A barrier of sufficient thickness may be made on a first board and then this board be applied to another board carrying the micro-machined or micro-engraved motor means.

What is claimed is:

1. A firing safety device for a pyrotechnic device, the firing safety device comprising:

at least one barrier to block a transmission channel connecting an igniter and a pyrotechnic charge, wherein said at least one barrier is made in the form of at least one micro-machined or micro-engraved element applied to or made on at least one board of a substrate, said at least one barrier is configured with a length greater than a thickness of said at least one barrier, said at least one board being oriented substantially parallel to said transmission channel which thus opens out opposite said at least one barrier at ends of the length, said pyrotechnic charge and said igniter thus lying on opposite sides of said at least one barrier and opposite the ends of the length.

2. A safety device according to claim 1, wherein said transmission channel has a section whose surface area is less than or equal to 1 $mm^2$ and greater than the priming surface area of said pyrotechnic charge.

3. A safety device according to claim 1, wherein said at least one barrier is moved by the action of a motor between a safety position in which said at least one barrier blocks said transmission channel and an armed position in which said at least one barrier unblocks at least partially one part of said transmission channel, said motor being made in the form of parts that micro-machined or micro-engraved on said at least one board.

4. A safety device according to claim 3, comprising at least two of the micro-machined or micro-engraved boards stacked on top of one another, control means ensuring the synchronised movement of the barrier or barrier elements of the different boards.

5. A safety device according to claim 3, wherein said motor is configured so as to ensure the reversibility of the movement of said at least one barrier.

6. A safety device according to claim 1, comprising at least two of the micro-machined or micro-engraved boards stacked on top of one another, control means ensuring the synchronised movement of said at least one barrier of said at least one board.

7. A safety device according to claim 1, wherein said at least one barrier comprises at least two elements able to move with respect to one another to unblock said transmission channel.

8. A safety device according to claim 7, wherein said at least two elements comprise mating profiles at their contact zone whose juxtaposition constitutes at least one deflector ensuring gastightness for the gases generated by said igniter.

9. A safety device according to claim 1, wherein said at least one barrier is held in the safety position by a lock micro-machined or micro-engraved onto said at least one board.

10. A safety device according to claim 1, comprising at least two of the barriers, which, joined together, block the transmission channel.

* * * * *